US006062107A

United States Patent [19]

Johnson

[11] Patent Number: 6,062,107

[45] Date of Patent: May 16, 2000

[54] BEVERAGE BOTTLE CORK OR CAP REMOVER

[75] Inventor: Breck N. Johnson, San Diego, Calif.

[73] Assignee: Cover Co. Inc., San Diego, Calif.

[21] Appl. No.: 09/233,769

[22] Filed: Jan. 19, 1999

[51] Int. Cl.[7] ..... B67B 7/16

[52] U.S. Cl. ..... 81/3.56; 81/3.55; 81/3.36

[58] Field of Search ..... 81/3.56, 3.55, 81/3.37, 3.36, 3.07

[56] References Cited

U.S. PATENT DOCUMENTS

| | | | |
|---|---|---|---|
| 930,732 | 8/1909 | Coughlin | 81/3.55 |
| 1,214,802 | 2/1917 | Low | 81/3.55 |
| 4,018,110 | 4/1977 | Spriggs | 81/3.56 |
| 4,387,609 | 6/1983 | Polsfuss | 81/3.55 |
| 4,519,277 | 5/1985 | Raab | 81/3.55 |
| 4,680,993 | 7/1987 | Feliz | 81/3.37 |
| 4,875,394 | 10/1989 | Crudgington, Jr. | 81/3.55 |
| 5,016,499 | 5/1991 | Saveland | 81/3.37 |

*Primary Examiner*—David A. Scherbel
*Assistant Examiner*—Joni B. Danganan
*Attorney, Agent, or Firm*—Juettner Pyle & Piontek

[57] ABSTRACT

A bottle opener especially devised for removing corks from champagne bottles includes two levers pivotally connected together at their proximal ends and having distal end portions for engagement respectively with the tapered neck of the bottle and under the shoulder on the cork. The lever engaging the neck of the bottle provides a fulcrum from which a significant mechanical advantage can be generated through the compound action of the levers to readily eject the cork from the bottle.

11 Claims, 2 Drawing Sheets

FIG. 2
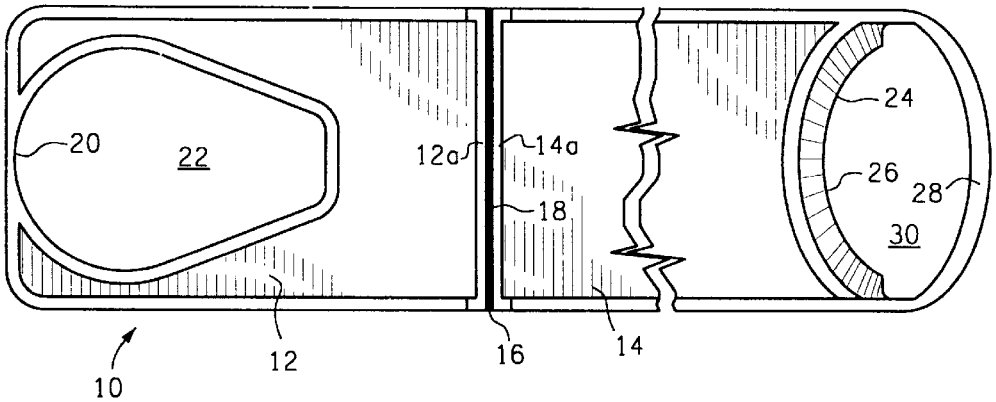
FIG. 3
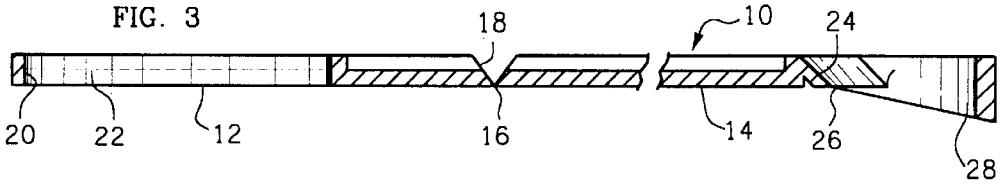
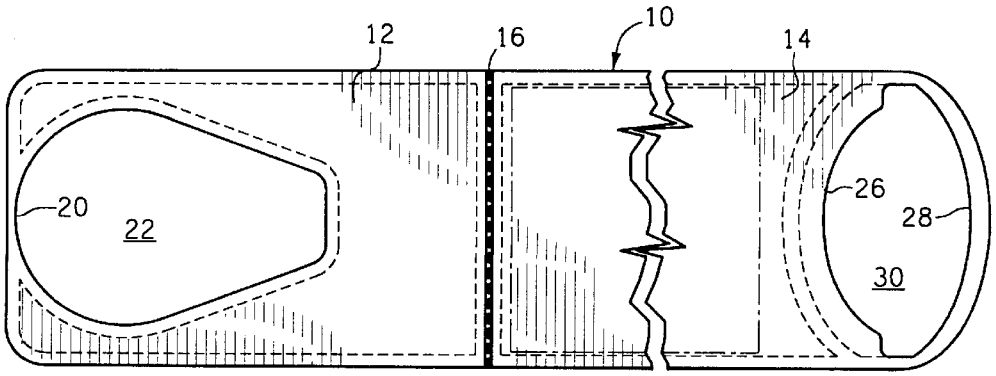
FIG. 4

BEVERAGE BOTTLE CORK OR CAP REMOVER

FIELD OF THE INVENTION

The present invention relates to bottle openers, particularly an opener for removing a shouldered cork or cap from a bottle or like container having a tapered or shouldered neck, and more particularly, for removing the cork from champagne bottles.

BACKGROUND

Champagne and similar effervescent beverages are customarily bottled in glass containers having a tapered neck leading to a small opening at the top of the container. The container is customarily closed by a cork having a small diameter body and a larger diameter top, with an intervening downwardly facing shoulder. The body of the cork is inserted into the top opening of the container or bottle until the shoulder of the cork engages the top of the bottle. The cork is then wired to the bottle to retain the cork in the bottle during the time the wine ferments and generates the desired effervescent gases.

As gas pressure within the bottle increases, the body portion of the cork is compressed and expanded outwardly into the tapered neck of the bottle bottle such that the cork is wedged in the neck of the bottle by a force of such magnitude that the body of the cork, when released from the bottle, will have a diameter much greater than that of the opening in the top of the bottle. As a consequence, it can be extremely difficult and/or time consuming to remove the cork from the bottle.

Usually, a person presses both thumbs upwardly on the cork at the shoulder in an effort to pry the cork out, and/or attempts to twist the top of the cork in order (more or less) to screw the cork out of the bottle.

Both methods can be painful to the thumbs and hand and extremely frustrating, especially when a number of bottles have to be opened, for example, at a reception.

SUMMARY OF THE INVENTION

The object of the invention is to provide an opener for easily, quickly and conveniently removing the cork or cap from a champagne or like bottle.

Another object is to incorporate in such opener means for gaining leverage and a substantial mechanical advantage over the forces that retain the cork in the bottle, thereby to facilitate removal of the cork with ease.

In accordance with the invention, the opener comprises two levers pivotally connected together at their proximal ends and having distal end portions for engagement respectively with the tapered neck of the bottle and under the shoulder on the cork. The lever engaging the neck of the bottle provides a fulcrum from which a significant mechanical advantage can be generated through the compound levers to readily eject the cork from the bottle.

The opener is easy to operate, economical to manufacture and facilitates the removal of shouldered caps and corks from a variety of containers having a tapered or shouldered neck, for example, beer bottles as well as champagne bottles.

The objects and advantages of the invention will become apparent to those of reasonable skill in the art from the following detailed description as considered in conjunction with the accompanying drawings.

BRIEF DESCRIPTION OF THE DRAWINGS

FIG. 2 is a top plan view of the preferred embodiment of the opener;

FIG. 3 is a longitudinal cross-section of the same; and

FIG. 4 is a bottom plan view of the same.

DETAILED DESCRIPTION OF A PREFERRED EMBODIMENT

Figure 1:
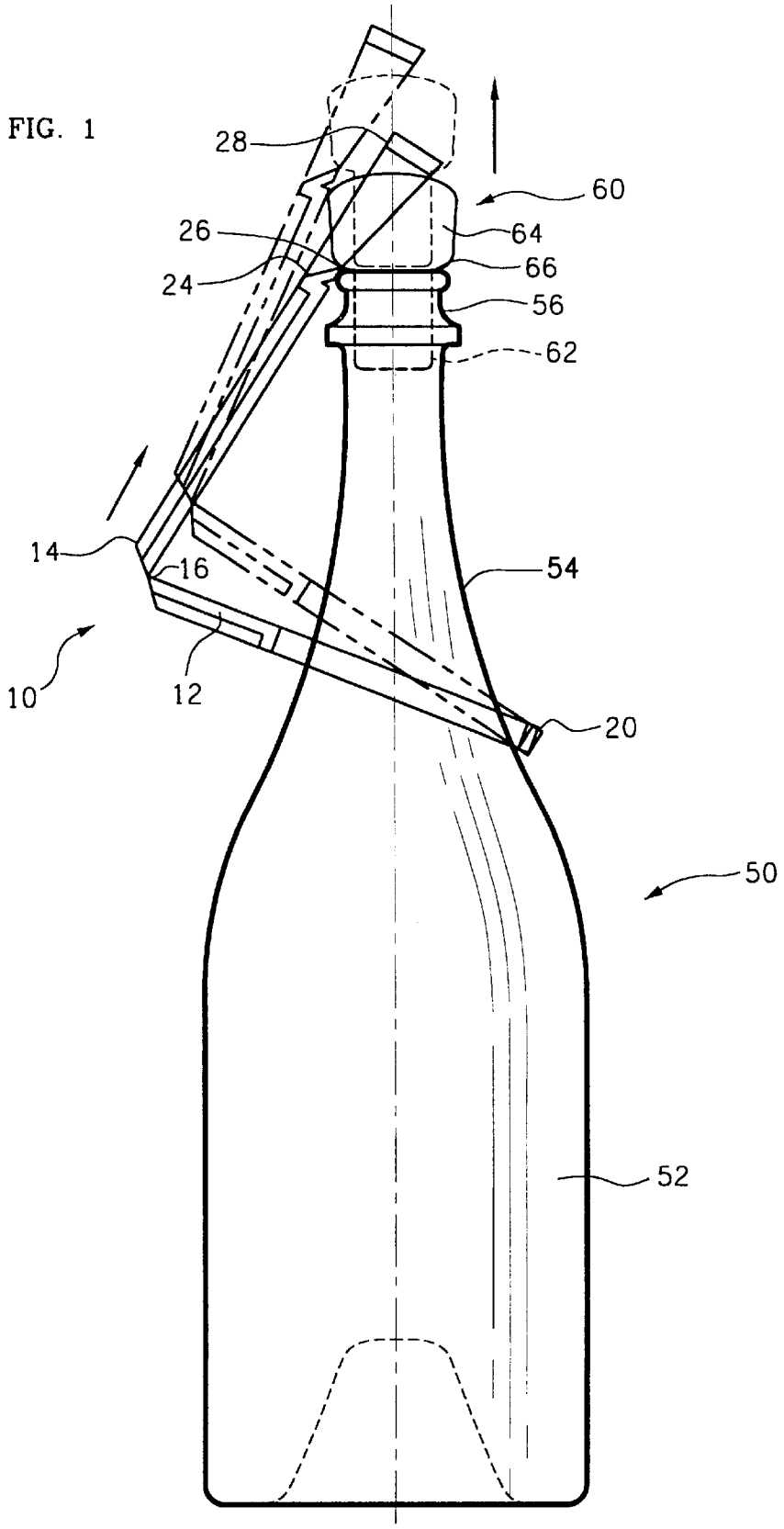
FIG. 1 is a side elevation of a preferred embodiment of the opener of the invention showing the same associated with a champagne bottle and illustrating in solid lines the initial engagement of the opener with the bottle and the cork, and in dot-dash lines the movement of the opener to eject the cork from the bottle.

The following is a detailed description of one embodiment of the invention that is presently contemplated by the inventor to be the best mode of carrying out his invention.

Referring initially to FIGS. 2, 3 and 4, the opener of the invention, in its preferred embodiment, comprises a flat and generally rectangular body 10 having a width greater than that of the top and upper portion of the neck of a champagne or similar bottle and of a length sufficient to form two levers 12 and 14 which are pivotally connected at their inner or proximal ends 12*a* and 14*a* by a hinge 16. The body 10 may suitably be about 2½ inches wide and about 8 inches long, but these dimensions are representative and subject to variation.

The two levers 12 and 14 may comprise two separate members pivotally interconnected by any conventional form of hinge or pivotal connection. Preferably, however, the body 10 comprises a unitary or integral member formed or molded of a suitable plastic and divided transversely of its length by an integral hinge 16 to define the levers 12 and 14.

As illustrated in FIG. 3, the hinge 16 may suitably be formed by a V depression 18 cut or molded into the body 10 and leaving a narrow web intervening between the two levers and comprising the hinge 16. As illustrated in FIG. 3, the hinge 16 permits the two levers to swing downwardly toward the bottom of the sheet of drawings, and the V cut is such as to prevent upward movement of the levers beyond the coplanar position illustrated.

At its distal end portion, the lever 12 is provided with one or more surfaces for engaging the neck of a bottle and for defing on the neck a fulcrum point for the lever 12, and in turn the lever 14. In the preferred embodiment, the fulcrum surface or surfaces are defined by the marginal edges 20 of a generally longitudinal elliptical opening 22 in the distal end portion of the lever 10. The opening 22 is configured to complement the neck of a bottle, as illustrated schematically in FIG. 1, and serves to tether the opener on the bottle to facilitate convenient and facile manipulation of the opener.

At its distal end, the lever 14 has a concave arcuate end surface 24 conformed generally to the circular curvature of a champagne bottle cork and adapted to be inserted under the shoulder of the cork, i.e., between the cork and the top of the bottle. To facilitate insertion of the surface 24 between the bottle and the cork, the surface has a sharp or pointed edge 26 and is sloped or tapered away from the edge to form a wedge or prying surface for effecting initial movement of the cork outwardly relative to the bottle.

Optionally, but preferably, the distal end of the lever 14 is also provided with an arcuate bight portion 28 which, when the opener is used, will overlie the cork and prevent, or at least mitigate, the consequences of explosive discharge of the cork from the bottle caused by the build-up of gas pressure within the bottle during fermentation of the wine.

Nevertheless, even though the bight portion 28 holds the cork somewhat captive upon discharge from the bottle, and prevents the cork from becoming a high speed projectile capable of hitting the ceiling or a bystander, it does not diminish the characteristic "pop" sound occurring upon opening of a bottle of good champagne. Together, the surface 24 and the bight 28 define a transverse elliptical opening in the distal end of the lever 14.

Referring now to FIG. 1, the opener 10 is illustrated in association with a champagne bottle 50 having a main body portion 52, a tapered neck 54 and a top 56 having an opening therein. Inserted within the opening at the top of the bottle is a cork 60 having a small diameter body portion 62 extending into the neck of the bottle, an enlarged top portion 64 above the bottle, and an intervening downwardly facing shoulder 66 engaging the top of the bottle.

As the bottle and cork are illustrated in FIG. 1, the wire customarily used to secure the cork to the bottle during fermentation, and the customary protective overwrap, have been removed so that the bottle is ready to be uncorked.

As shown in solid lines in FIG. 1, the opener is tethered to the bottle by positioning the body 10 above the bottle with the V cut 18 facing downwardly, aligning the opening 22 with the top of the bottle and lowering lever 12 onto the bottle until the surface or surfaces 20 engage the tapered neck (or alternatively a shoulder) on the bottle, whereby the distal end of the lever 12 is pivotally fulcrumed on the bottle. The lever 14 is then pivoted or folded upward to position the bight 28 over the cork and to align the edge 26 on the surface 24 with the shoulder on the cork. As shown, the lengths of the levers are such that the lever 14 is positioned at an acute angle relative to the neck of the bottle so as to exert force primarily in a vertically upward direction on the cork.

Then, as illustrated by the arrows and dot-dash lines in FIG. 1, the exertion of upward pressure on the proximal end of lever 12 causes the surface 24 of lever 14 to enter between the top of the bottle and the downwardly facing surface of the shoulder of the cork, and continued exertion of said pressure forces the cork upwardly out of the bottle. After some degree of upward movement of the cork, the gas pressure in the bottle will usually blow the cork out of the bottle with the characteristic "pop". As the cork is discharged from the bottle, it engages the bight 28 and is prevented from becoming a live projectile.

Due to the fulcruming of the lever 12 on the bottle and the compound action of the two pivotally connected levers 12 and 14, a very significant mechanical advantage is afforded the operator of the opener so that only modest pressure need be exerted on the lever 12 to effect removal of even the most stubborn cork.

The objects and advantages of the invention have therefore been shown to be attained in a convenient, economical, practical and facile manner.

While a preferred embodiment of the invention has been herein illustrated and described, it is to be appreciated that various changes, rearrangements and modifications may be made therein without departing from the scope of the present invention as defined by the accompanying claims.

What is claimed is:

1. An opener for removing a shouldered cork or cap from a container having a tapered or shouldered neck comprising a first lever having a first end for engaging the neck of the container and a second end spaced from the container, and a second lever having a first end pivotally connected to the second end of said first lever and a second end for engaging the shoulder of the cork or cap, whereby application of force upwardly on the second end of said first lever will cause the cork or cap to be removed from the container, said first and second levers comprising a unitary member having an integral hinge section between the first end of said second lever and the second end of said first lever.

2. An opener as set forth in claim 1 wherein said first end of said first lever has an opening therethrough for receiving the neck of the container whereby said first lever will be tethered on the container.

3. An opener as set forth in claim 1 wherein said second end of said second lever has a sharp edge for engaging under the shoulder of the cork or cap.

4. An opener as set forth in claim 1 wherein said second end of said second lever has an opening therethrough defining an inner edge portion for engaging under the shoulder of the cap or cork and an outer portion adapted to overlie the cork or cap for controlling discharge of the cork or cap from the container.

5. An opener as set forth in claim 4 wherein said outer portion is normally spaced upwardly from the cork or cap to permit the cork or cap to be discharged from the bottle with a popping sound.

6. An opener for removing a shouldered cork or cap from a container having a tapered or shouldered neck comprising a flat generally rectangular body having adjacent its midpoint an integral hinge dividing the body into first and second levers pivotally joined at their proximal ends, one of said levers having a support surface adjacent the distal end thereof for engaging the neck of the container, the other of said levers having a prying surface at the distal end thereof for engaging under the shoulder of the cork or cap, whereby application of upward force on the proximal end of said first lever will cause the cork or cap to be removed from the container.

7. An opener as set forth in claim 6 wherein the distal end of said one lever has an opening therethrough for receiving the neck of the container and tethering the opener on the container.

8. An opener as set forth in claim 6 wherein the distal end of said other lever has an opening therethrough defining an inner edge portion for engaging under the shoulder of the cork or cap and an outer portion adapted to overlie the cork or cap for controlling discharge of the cork or cap from the container.

9. An opener as set forth in claim 8 wherein said inner edge portion is tapered and terminates in a sharp edge for engagement between the shoulder on the cork or cap and the top of the container.

10. An opener as set forth in claim 8 wherein said outer portion is normally spaced upwardly from the cork or cap to permit the cork or cap to be discharged from the container with a popping sound.

11. An opener for removing a shoulder cork or cap from a container having a tapered or shouldered neck comprising two flat generally rectangular levers of substantially the same size, said levers having juxtaposed flat proximal ends and being pivotally connected at their proximal ends, one of said levers having a support surface adjacent the distal end thereof for engaging the neck of the container, the other of said levers having a prying surface at the distal end thereof for engaging under the shoulder of the cork or cap, whereby application of upward force on the proximal end of said one lever will cause the cork or cap to be removed from the container.

* * * * *